US009931758B2

(12) United States Patent
Ohnishi

(10) Patent No.: US 9,931,758 B2
(45) Date of Patent: Apr. 3, 2018

(54) PLASTIC FILM PUNCHING APPARATUS

(71) Applicant: Totani Corporation, Kyoto (JP)

(72) Inventor: Hideo Ohnishi, Kyoto (JP)

(73) Assignee: Totani Corporation, Kyoto (JP)

( * ) Notice: Subject to any disclaimer, the term of this patent is extended or adjusted under 35 U.S.C. 154(b) by 137 days.

(21) Appl. No.: 14/979,960

(22) Filed: Dec. 28, 2015

(65) Prior Publication Data

US 2017/0036368 A1 Feb. 9, 2017

(30) Foreign Application Priority Data

Aug. 5, 2015 (JP) ..... 2015-155249

(51) Int. Cl.

| | |
|---|---|
| ***B26D 7/18*** | (2006.01) |
| ***B26F 1/02*** | (2006.01) |
| ***B26F 1/14*** | (2006.01) |
| ***B26F 1/44*** | (2006.01) |

(52) U.S. Cl.

CPC ..... *B26D 7/1863* (2013.01); *B26D 7/1854* (2013.01); *B26F 1/02* (2013.01); *B26F 1/14* (2013.01); *B26F 1/44* (2013.01)

(58) Field of Classification Search

CPC ..... B26D 7/1863; B26D 7/1854; B26F 1/02; B26F 1/14

USPC ..... 83/98–100

See application file for complete search history.

(56) References Cited

U.S. PATENT DOCUMENTS 4,160,396 A 7/1979 Matzner
4,425,829 A * 1/1984 Kranik ..... H05K 3/005 234/33
4,628,780 A * 12/1986 Hicks ..... B21D 45/003 83/621
5,111,723 A * 5/1992 Andrusch ..... B26D 7/1854 83/24
5,907,985 A 6/1999 Bezama
6,003,418 A * 12/1999 Bezama ..... B26D 7/1854 83/100
6,341,549 B2 * 1/2002 Kim ..... B26D 7/1854 29/827

(Continued)

FOREIGN PATENT DOCUMENTS

| | | |
|---|---|---|
| EP | 2842704 | 3/2015 |
| FR | 2387103 | 11/1978 |

(Continued)

OTHER PUBLICATIONS

Koga and Aoki, "A Press Punch Processing Method", Nikkan Kogyo Shinbun, Ltd., pp. 79 and 83, Mar. 21, 2002.

(Continued)

*Primary Examiner* — Omar Flores Sanchez

(74) *Attorney, Agent, or Firm* — Kirschstein, Israel, Schiffmiller & Pieroni, P.C.

(57) ABSTRACT

A plastic film punching apparatus is improved to make a waste removed reliably. In the apparatus, a plastic film is sandwiched between and punched by male and female blades. The female blade has opposite surfaces which are first and second surfaces. The plastic film generates a waste which is pushed by the male blade to protrude from the second surface. A vacuum source and an opening cooperate with each other to suck air through the opening and generate airflow within the tubular cover, the waste being removed by the airflow.

6 Claims, 6 Drawing Sheets

(56) References Cited

U.S. PATENT DOCUMENTS

| | | | | |
|---|---|---|---|---|
| 7,479,004 | B2 * | 1/2009 | Naito | B21D 28/34 425/416 |
| 8,387,500 | B2 * | 3/2013 | Kato | B21D 28/34 83/552 |

FOREIGN PATENT DOCUMENTS

| | | |
|---|---|---|
| JP | 05057687 | 3/1993 |
| JP | 06-005898 | 1/1994 |
| JP | H08312399 | 11/1994 |
| JP | H07205095 | 8/1995 |
| JP | 2511207 | 4/1996 |
| JP | H1078635 | 3/1998 |
| JP | H11058297 | 3/1999 |
| JP | 2002-346986 | 12/2002 |
| JP | 2003326616 | 11/2003 |
| JP | 3655627 | 3/2005 |

OTHER PUBLICATIONS

Aoki and Sasada, "The factor generating punched slag", Press Technology, pp. 28 and 30, Oct. 2010.
"General Catalog", Tsukatani Hamono Mfg. Co., Ltd., Feb. 2012.
European Search Report issued in corresponding European Patent Application No. 16152078.8 dated Feb. 10, 2017.
Australian Search Report dated May 14, 2016 in corresponding Australian patent application No. 2016200028.

* cited by examiner

PLASTIC FILM PUNCHING APPARATUS

TECHNICAL FIELD

The invention relates to a plastic film punching apparatus.

BACKGROUND

For example, a plastic film punching apparatus is incorporated into a machine successively making plastic bags of plastic film, in which an aperture is formed in a plastic film. Japanese Laid-Open Utility Model Publication No, H06-5, 898 discloses the apparatus including a female blade, a through hole being formed in the female blade. A male blade is moved toward the female blade to be inserted into the through hole so that a plastic film is sandwiched between and punched by the male and female blades, the aperture being formed in the plastic film.

In this case, the plastic film generates a waste when being punched, the male blade and the waste being inserted into the through hole, so that the waste must be adhered to the male blade. In this connection, in the apparatus, an air passage is formed in the male blade to eject air to the waste from the air passage, the waste being removed by the ejected air.

However, the waste is not always peeled off the male blade and removed by the ejected air when ejecting the air to the waste. Accordingly, the waste may be then withdrawn by the male blade pulled out of the through hole, to be mixed into the plastic film.

The through hole is thought to be a cause. The waste must be held in the through hole to be restricted from movement when ejecting the air to the waste. The waste would therefore be difficult to be peeled off the male blade.

By the way, Japanese Patent No. 3,655,627 discloses a machine for successively making plastic bags of plastic film, in which plastic films are fed longitudinally thereof and intermittently. The machine includes a heat seal apparatus and a cutter by which the plastic films are heat sealed with each other and cross cut when the plastic films are stopped temporarily whenever being fed intermittently, to successively make the plastic bags. The same is true of the plastic film punching apparatus incorporated into the machine. The plastic film is punched by the apparatus when the plastic film is stopped temporarily whenever being fed intermittently.

It is therefore an object of the invention to provide a plastic film punching apparatus in which the waste is removed reliably.

SUMMARY OF THE INVENTION

According to the invention, the apparatus includes a female blade having opposite surfaces which are first and second surfaces. A male blade is opposed to the female blade at the first surface. A through hole is formed in the female blade for insertion of the male blade. A tubular cover is formed on the female blade at the second surface and about the through hole, the tubular cover being larger than the through hole. A vacuum source is connected to the tubular cover to make the tubular cover evacuated. An opening is formed in the tubular cover for suction of air at a position predetermined peripherally of the tubular cover. The apparatus further includes a drive by which the male blade is moved toward the female blade to be inserted into the through hole so that a plastic film is sandwiched between and punched by the male and female blades. The plastic film generates a waste which is inserted into the through hole.

The waste is pushed by the male blade to protrude from the second surface. The vacuum source and the opening cooperate with each other to suck air through the opening and generate airflow within the tubular cover, the waste being removed by the airflow.

In a preferred embodiment, the male blade has a width, the opening having a width corresponding to or larger than the width of the male blade.

The male blade goes through the female blade to protrude from the second surface. The waste protrudes from the second surface along with the male blade.

The opening is formed adjacent the second surface to generate the airflow adjacent the second surface.

The male blade is pronged to have two edges, the edges being spaced from each other in a direction of width of the male blade. The vacuum source and the opening generate the airflow in a direction of thickness of the male blade so that the air flows between the edges and between the male blade and the waste, resulting in the waste being peeled off the make blade reliably.

The vacuum source comprises a dust collector for collecting the wastes.

In addition, an air passage is formed in the male blade. An air supply is connected to the air passage to eject air to the waste from the air passage, assisting the airflow to make the waste removed.

BEST MODE FOR CARRYING OUT THE INVENTION

Figure 1A:
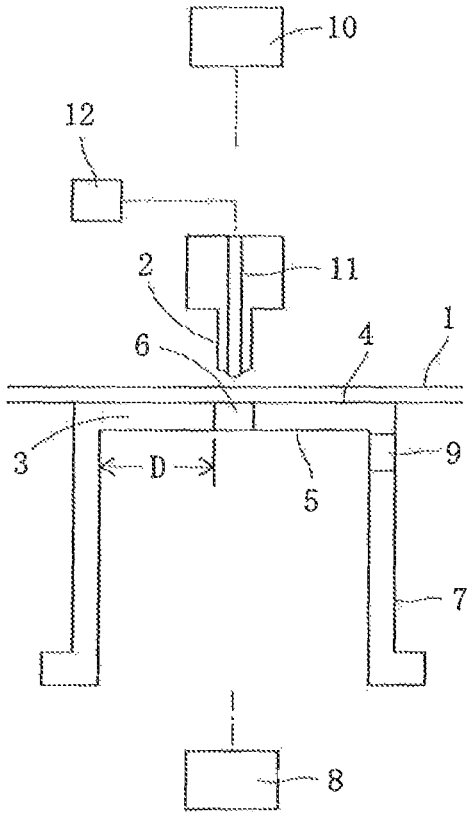
FIG. 1A is a longitudinal sectional view of a preferred embodiment of the invention.
Figure 1B:
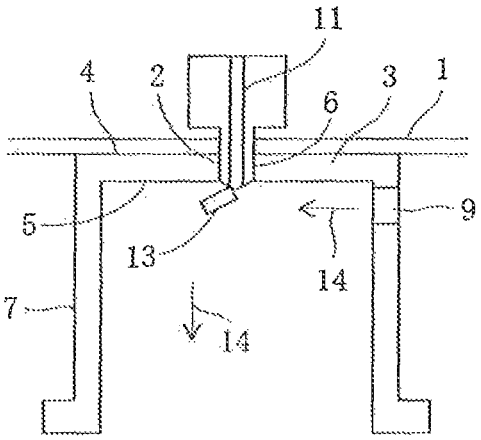
FIG. 1B is a longitudinal sectional view of the plastic film of FIG. 1A when being punched.

Turning now to the drawings, FIG. 1 illustrates a plastic film punching apparatus according to the invention. The apparatus is incorporated into a machine successively making plastic bags of plastic film, in which a plastic film 1 is punched by the apparatus. The apparatus includes male and female blades 2 and 3, the female blade 3 having opposite surfaces which are first and second surfaces 4 and 5. The male blade 2 is opposed to the female blade 3 at the first surface 4. A through hole 6 is formed in the female blade 3 for insertion of the male blade 2. A tubular cover 7 is formed on the female blade 3 at the second surface 5 and about the through hole 6, the tubular cover 7 being larger than the through hole 6. The tubular cover 7 is spaced from the through hole 6 at a distance D which is larger than the through hole 6.

In the embodiment, the female blade 3 has a disc shape while the tubular cover 7 is cylindrical. The tubular cover 7 extends vertically to have a top end which is closed by the female blade 3. The female blade 3 is formed integrally with the tubular cover 7. The through hole 6 is concentric with the tubular cover 7. The male blade 2 is disposed upwardly of the through hole 6. The tubular cover 7 may have an angled shape or another shape.

A vacuum source 8 is connected to the tubular cover 7 to make the tubular cover 7 evacuated. An opening 9 is formed in the tubular cover 7 for suction of air at a position predetermined peripherally of the tubular cover 7. In the embodiment, the vacuum source 8 comprises a dust collector while the opening 9 is formed adjacent the second surface 5.

The apparatus further includes a drive 10 by which the male blade 2 is moved toward the female blade 3 to be inserted into the through hole 6, the drive 10 comprising an actuator such as an air cylinder or motor. The drive 10 is connected to the male blade 2.

In addition, an air passage 11 is formed in the male blade 2. An air supply 12 is connected to the air passage 11, the air supply 12 comprising a compressor.

The apparatus is incorporated into the machine in which plastic films 1 are fed longitudinally thereof and intermittently, as in the case of the machine of Japanese Patent No. 3,655,627. The machine includes a heat seal apparatus and a cutter by which the plastic films 1 are heat sealed with each other and cross cut when the plastic films 1 are stopped temporarily whenever being fed intermittently, to successively make the plastic bags. In addition, one of the plastic films 1 is directed between the male and female blades 2 and 3. The male blade 2 is moved toward the female blade 3 to be inserted into the through hole 6 so that the plastic film 1 is sandwiched between and punched by the male and female blades 2 and 3 when the plastic film 1 is stopped temporarily whenever being fed intermittently.

The plastic film 1 generates a waste 13 when being punched, the male blade 2 and the waste 13 being inserted into the through hole 6. The waste 13 is pushed by the male blade 2 to protrude from the second surface 5. The vacuum source 8 and the opening 9 cooperate with each other to suck air through the opening 9 and generate airflow 14 within the tubular cover 7, the waste 13 being removed by the airflow 14.

Figure 3A:
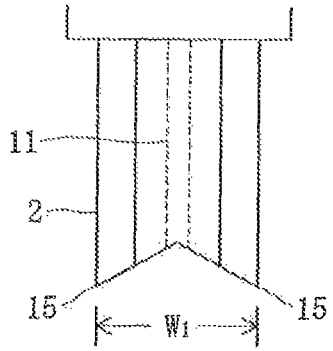
FIG. 3A is an elevational view of one embodiment of the male blade of FIG. 1.
Figure 4A:
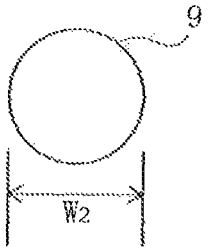
FIG. 4A is an explanatory view of one embodiment of the opening of FIG. 1.
Figure 4B:
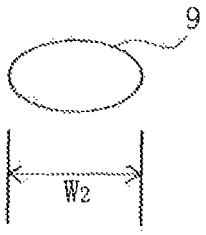
FIG. 4B is an explanatory view of another embodiment of the opening of FIG. 1.

The male blade 2 has a width (W1), as shown in FIG. 3A, the opening 9 having a width (W2) corresponding to or larger than the width (W1) of the male blade 2, as shown in FIG. 4A. The width (W2) is the size of the opening 9 in a direction of width of the male blade 2. In the embodiment, the male blade 2 is testudinal to have the width (W1) of 4 mm, the male blade 2 having a thickness (T) of 2 mm. The through hole 6 is also testudinal to have a size corresponding to that of the male blade 2. The opening 9 is circular to have the width (W2) which is a diameter (FIG. 4A). The opening 9 may be ellipse to have the width (W2) which is a length of long axis (FIG. 4B).

The male blade 2 goes through the female blade 3 to protrude from the second surface 5. The waste 13 protrudes from the second surface 5 along with the male blade 2. The waste 13 can therefore protrude reliably.

In addition, in the apparatus, the male blade 2 is pronged to have two edges 15, the edges 15 being spaced from each other in the direction of width of the male blade 2. The vacuum source 8 and the opening 9 generate the airflow 14 in a direction of thickness of the male blade 2 so that the air flows between the edges 15 and between the male blade 2 and the waste 13, resulting in the waste 13 being peeled off the male blade 2 reliably.

The vacuum source 8 comprises the dust collector, as described previously, for collecting the wastes 13. The waste 13 can therefore be peeled off the male blade 2 to be removed by the airflow 14 and directed into the dust collector for collection.

It should therefore be understood that in the apparatus, the male blade 2 and the waste 13 are inserted into the through hole 6 so that the waste 13 protrudes from the second surface 5. The waste 13 is then removed by the airflow 14 not in the through hole 6 but within the tubular cover 7, without being held in the through hole 6 to be restricted from movement. The tubular cover 7 is larger than the through hole 6 which has a size corresponding to that of the waste 13. Accordingly, it is inconceivable that the waste 13 is held in the tubular cover 7 to be restricted from movement. The waste 13 is therefore peeled off the male blade 2 to be removed by the airflow 14 reliably.

The opening 9 is formed adjacent the second surface 5, as described previously, to generate the airflow 14 adjacent the second surface 5. The waste 13 is therefore more likely to be peeled off the male blade 2.

Figure 2A:
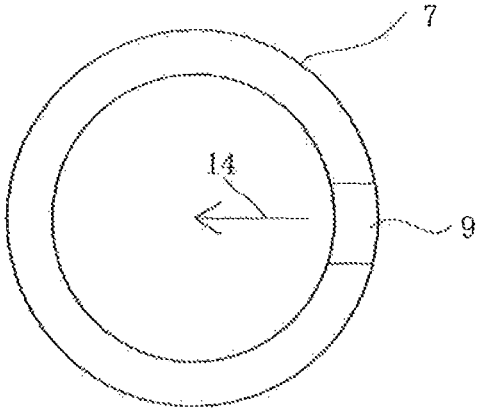
FIG. 2A is a cross sectional view of one embodiment of the tubular cover of FIG. 1.
Figure 2B:
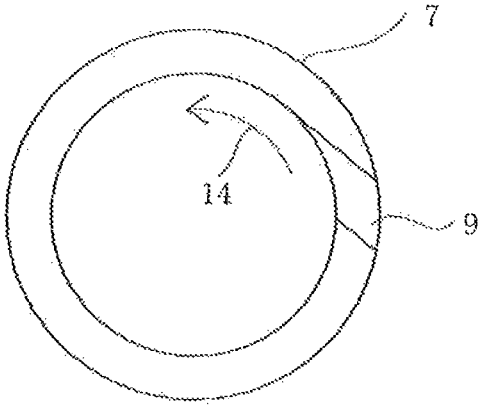
FIG. 2B is a cross sectional view of another embodiment of the tubular cover of FIG. 1.

In the embodiment, the opening 9 is formed in the tubular cover 7 radially thereof, as shown in FIG. 2A. The opening 9 may be formed in the tubular cover 7 tangentially thereof (FIG. 2B).

The apparatus is incorporated into the machine successively making plastic bags of plastic film, as described previously. In this connection, it should be understood that the machine has a problem that the waste 13 may be withdrawn by the male blade 2 pulled out of the through hole 6, to be mixed into the plastic film 1, if being not peeled off the male blade 2 for removal. In particular, the problem must be serious when the plastic bag is filled with food after making it.

Under the circumstances, the inventor has studied and tested about the relationship between the waste 13 to be removed and the size of the opening 9.

In this connection, it should be understood that in the apparatus of FIG. 1, the vacuum source 8 comprises the dust collector, the dust collector and the opening 9 cooperating with each other to suck the air through the opening 9. In this case, it is natural that the less the opening 9, the higher the speed of the air is obtained with the less the quantity of the air. By contraries, the larger the opening 9, the larger the quantity of the air is obtained with the lower the speed of the air. According to a test, the suction of the air has been accomplished through the opening 9 at a speed of 47.8 m/sec and a quantity of 9 l/min when the dust collector is operated to generate a negative pressure of 2.6 kPa and the opening 9 is circular to have a diameter of 2 mm. The suction of the air has been accomplished through the opening 9 at a speed of 41.1 m/sec and a quantity of 31 l/min when the opening 9 has a diameter of 4 mm. The suction of the air has been accomplished through the opening 9 at a speed of 27.1 m/sec and a quantity of 46 l/min when the opening 9 has a diameter of 6 mm.

Figure 3B:
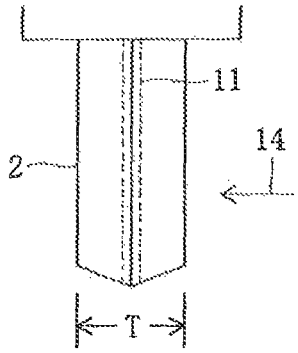
FIG. 3B is a side view of the male blade of FIG. 3A.
Figure 3C:
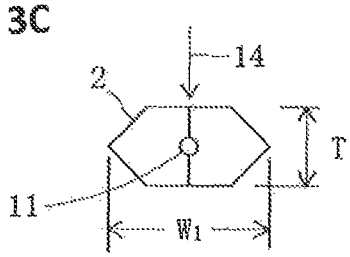
FIG. 3C is a bottom view of the male blade of FIG. 3A.

It should also be understood that the speed and quantity of the air affect the waste 13 to be removed. In addition, in the test, the same male blade 2 has been used as the embodiment of FIGS. 3A-3C, so that the air flows between the edges 15 and between the male blade 2 and the waste 13. The male blade 2 has the width (W1) of 4 mm.

Furthermore, in the test, first, the inventor has tried to make the plastic film 1 punched by the male and female blades 2 and 3, 6,000 times, with no opening 9 formed in the tubular cover 7. In this case, the waste 13 would fall in the machine at a position downstream of the male blade 2 when being not peeled off the male blade 2 for removal. In fact, the waste 13 has fallen, nine times. The plastic film 1 has then been punched by the male blade 2, 6,000 times, with the opening 9 formed in the tubular cover 7, the opening 9 being circular to have a diameter of 2 mm. In this case, the waste 13 has fallen, five times.

On the other hand, in the test, the waste 13 has fallen, one time, when the plastic film 1 is punched by the male blade 2, 6,000 times, with the opening 9 having a diameter of 4 mm. No waste 13 has fallen, when the plastic film 1 is punched by the male blade 2, 6,000 times, with the opening 9 having a diameter of 6 mm. No waste. 13 has then fallen, when the plastic film 1 is punched again, 6,000 times, just to be sure.

Consequently, it has been known that the opening 9 is ineffective to make the waste 13 removed when having the diameter of 2 mm, due to the shortage of air in quantity, in spite of high speed. It has also been known that the opening 9 is effective to make the waste 13 removed when having the diameter of 4 mm, because of the waste 13 very rarely falling, and when having the diameter of 6 mm, because of no waste 13 falling. In the test, the male blade 2 has the width (W1) of 4 mm, as described previously.

It should therefore be recognized that the test has indicated the importance of the width (W2) of the opening 9 relative to the width (W1) of the male blade 2. The width (W2) is the diameter of the opening 9 which is circular, as also described previously. The width (W2) may be the length of long axis of the opening 9 which is ellipse. As a result, a conclusion has been obtained that the waste 13 is removed reliably when the width (W2) corresponds to or larger than the width (W1), in the apparatus of FIG. 1.

Figure 5A:
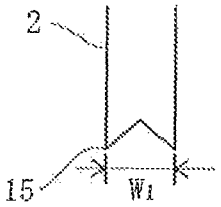
FIG. 5A is an elevational view of another embodiment of the male blade of FIG. 1.
Figure 5B:
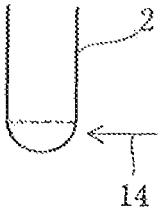
FIG. 5B is a side view of the male blade of FIG. 5A.
Figure 5C:
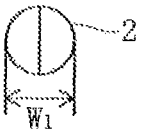
FIG. 5C is a bottom view of the male blade of FIG. 5A.

The male blade 2 and the through hole 6 may be circular, as shown in FIGS. 5A-5C. In the embodiment of FIGS. 5A-5C, the male blade 2 is pronged to have two edges 15 so that the air flows between the edges 15 and between the male blade 2 and the waste 13. The male blade 2 has a width (W1), the opening 9 having a width (W2) corresponding to or larger than the width (W1) of the male blade 2.

The male blade 2 may have a diamond shape or another shape.

In addition, the air supply 12 is connected to the air passage 11, as described previously, to eject air to the waste 13 from the air passage 11, assisting the airflow 14 to make the waste 13 removed.

Figure 6A:
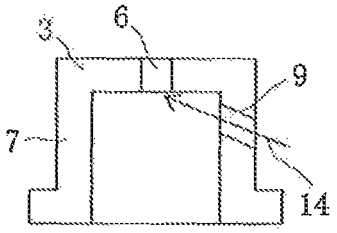
FIG. 6A is a longitudinal sectional view of an additional embodiment of the tubular cover of FIG. 1.
Figure 6B:
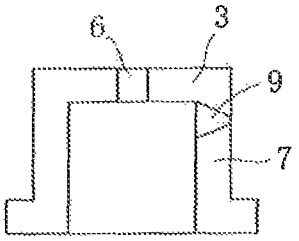
FIG. 6B is a longitudinal sectional view of a further embodiment of the tubular cover of FIG. 1.
Figure 6C:
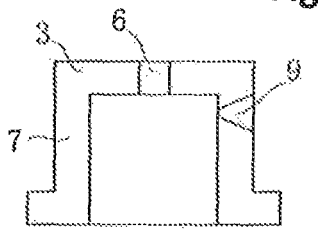
FIG. 6C is a longitudinal sectional view of another embodiment of the tubular cover of FIG. 1.
Figure 6D:
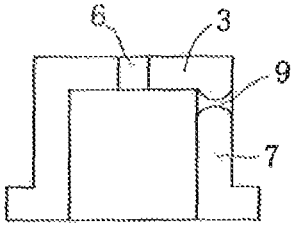
FIG. 6D is a longitudinal sectional view of still another embodiment of the tubular cover of FIG. 1.

The opening 9 may be inclined appropriately, as shown in FIG. 6A. The opening 9 may be enlarged in a direction in which the air flows (FIG. 6B). By contraries, the opening 9 may be contracted in the direction (FIG. 6C). In this case, the opening 9 should have a width (W2) corresponding to or larger than the width (W1) of the male blade 2 at the inner surface of the tubular cover 7. The opening 9 may have an orifice shape (FIG. 6D).

What is claimed is:

1. A plastic film punching apparatus comprising:

a female blade having opposite surfaces which are first and second surfaces;

a male blade opposed to the female blade at the first surface;

a through bole formed in the female blade for insertion of the male blade;

a tubular cover formed on the female blade at the second surface and about the through hole, the tubular cover being larger than the through hole;

a vacuum source connected to the tubular cover to make the tubular cover evacuated;

an opening formed in the tubular cover for suction of air at a position predetermined peripherally of the tubular cover; and a drive by which the male blade is moved toward the female blade to be inserted into the through hole so that a plastic film is sandwiched between and punched by the male and female blades, the plastic film generating a waste which is inserted into the through hole, the waste being pushed by the male blade to protrude from the second surface, the vacuum source and the opening cooperating with each other to suck air through the opening and generate airflow within the tubular cover, the waste being removed by the airflow, wherein the male blade is two-pronged to have two edges, the edges being spaced from each other in a direction of width of the male blade, the vacuum source and the opening generating the airflow in a direction of thickness of the male blade so that the air flows between the edges and between the male blade and the waste, resulting in the waste being peeled off the male blade reliably.

2. The apparatus as set forth in claim 1 wherein the male blade has a width, the opening having a width corresponding to or larger than the width of the male blade.

3. The apparatus as set forth in claim 2 wherein the male blade goes through the female blade to protrude from the second surface, the waste protruding from the second surface along with the male blade.

4. The apparatus as set forth in claim 2 wherein the opening is formed adjacent the second surface to generate the airflow adjacent the second surface.

5. The apparatus as set forth in claim 1 wherein the vacuum source comprises a dust collector for collecting the wastes.

6. The apparatus as set forth in claim 1 further comprising:

an air passage formed in the male blade; and an air supply connected to the air passage to eject air to the waste from the air passage, assisting the airflow to make the waste removed.

* * * * *